US011213731B1

(12) United States Patent
Anderson

(10) Patent No.: US 11,213,731 B1
(45) Date of Patent: Jan. 4, 2022

(54) ADJUSTABLE TARGET SYSTEM

(71) Applicant: Joseph M. Anderson, Sanborn, NY (US)

(72) Inventor: Joseph M. Anderson, Sanborn, NY (US)

( * ) Notice: Subject to any disclaimer, the term of this patent is extended or adjusted under 35 U.S.C. 154(b) by 0 days.

(21) Appl. No.: 16/408,967

(22) Filed: May 10, 2019

(51) Int. Cl.
*A63B 69/00* (2006.01)
*A63B 63/00* (2006.01)
*A63B 63/06* (2006.01)

(52) U.S. Cl.
CPC ..... *A63B 63/004* (2013.01); *A63B 63/06* (2013.01); *A63B 69/002* (2013.01); *A63B 69/0024* (2013.01); *A63B 2063/065* (2013.01)

(58) Field of Classification Search
CPC ..... A63B 24/0021; A63B 63/003; A63B 63/004; A63B 63/06; A63B 63/0024; A63B 69/002; A63B 69/0024; A63B 2063/065; A63B 71/0622
USPC ..... 473/422, 446, 476–478, 454–456, 470, 473/471; 248/62, 74.1; 273/398–402
See application file for complete search history.

(56) References Cited

U.S. PATENT DOCUMENTS 1,164,613 A * 12/1915 Jewell ..... H02G 7/10 248/61
1,232,048 A * 7/1917 Kolkmeier ..... E05D 5/02 16/253
1,261,678 A * 4/1918 Randall et al. ..... E05D 5/02 16/253
2,281,151 A * 4/1942 Granger ..... A24F 19/10 248/305
2,426,479 A * 8/1947 Wohlhieter ..... H02G 7/10 248/74.3
2,651,806 A * 9/1953 Thompson ..... E06B 11/04 16/253
2,821,762 A * 2/1958 Foose ..... A47C 1/124 248/440.1
2,992,002 A * 7/1961 Bingham, Jr. ..... A63B 69/0097 473/421
3,268,946 A * 8/1966 Case ..... E06B 11/04 16/253
3,385,545 A * 5/1968 Patton ..... F16L 3/222 248/68.1
3,521,332 A * 7/1970 Kramer ..... F16B 2/22 248/74.2
36,646,621 * 5/1972 Savoie, Jr. ..... E21B 43/0107 248/74.1
4,526,756 A * 7/1985 Wong ..... B01L 9/06 206/443
4,736,921 A * 4/1988 Zane ..... B62J 11/00 248/229.24

(Continued)

FOREIGN PATENT DOCUMENTS

DE 102011116701 B4 4/2013
EP 0106184 A1 * 4/1984 ..... A63B 63/00
WO WO-2007135456 A1 * 11/2007 ..... A63B 63/00

*Primary Examiner* — Mitra Aryanpour
(74) *Attorney, Agent, or Firm* — Woods Oviatt Gilman LLP; Dennis B. Danella, Esq.

(57) ABSTRACT

An adjustable target system for use on a goal having a first post, a second post, and a crossbar. The adjustable target system includes a frame and a bracket configured and arranged for adjustably attaching the frame to one of the first post, second post, and crossbar. The bracket is configured and arranged for removably attaching to one of the first post, second post and crossbar without the use of tools.

18 Claims, 8 Drawing Sheets

(56) References Cited

U.S. PATENT DOCUMENTS 4,948,147 A * 8/1990 Pallanca ..... A63B 63/00 473/478
5,503,402 A 4/1996 Moss
5,593,143 A * 1/1997 Ferrarin ..... E04H 17/08 248/68.1
5,628,515 A * 5/1997 Levy ..... A63B 63/06 473/446
5,704,855 A * 1/1998 Kellogg, Jr. ..... A63B 63/00 473/422
5,888,153 A * 3/1999 Masin ..... A63B 63/00 473/446
6,068,488 A * 5/2000 Sinsheimer ..... A63B 69/002 434/247
6,461,258 B1 * 10/2002 Vacanti ..... A63B 61/003 473/494
6,692,384 B2 2/2004 Bains
6,695,724 B2 * 2/2004 Birss ..... A63B 63/004 473/446
6,807,710 B2 * 10/2004 Abbott ..... E05D 3/12 16/221
7,066,848 B2 6/2006 Unger
7,134,976 B1 * 11/2006 Smith ..... A63B 24/0021 473/446
7,467,490 B2 * 12/2008 Mossberg ..... F41A 21/08 42/77
7,467,767 B2 * 12/2008 Miles ..... F16L 3/1008 248/74.1
7,661,679 B2 * 2/2010 Mah ..... A63B 63/004 473/446
9,717,968 B2 8/2017 Olsen
10,195,508 B2 2/2019 Rigoli
10,471,324 B2 * 11/2019 Torres ..... A63B 69/002 473/446
2003/0228941 A1 * 12/2003 Bains ..... A63B 63/004 473/446
2006/0033284 A1 * 2/2006 Birss ..... A63B 63/003 473/476
2006/0116226 A1 6/2006 Padilla
2008/0283688 A1 * 11/2008 Kaneko ..... F16B 5/0685 248/74.1
2011/0230284 A1 * 9/2011 Simon ..... F41J 1/10 473/485
2013/0303312 A1 * 11/2013 DeBolt ..... A63B 69/00 473/446
2015/0196819 A1 * 7/2015 Markham ..... A63B 71/0622 473/446

* cited by examiner

ADJUSTABLE TARGET SYSTEM

TECHNICAL FIELD

The present invention relates generally to the field of sports training devices, and more particularly to an adjustable target system for mounting on a goal for sports such as soccer, lacrosse, hockey, or the like.

BACKGROUND ART

U.S. Patent Publication No. 2006/0116226 A1 discloses a net pole supporting a net that is attached to a support pole by means of clamps that attach around the net pole and support pole by means of a nut and bolt.

U.S. Pat. No. 10,195,508 discloses a tool less backstop net having a corner bracket assembly that attaches to an existing goal by means of a clamp apparatus having a knob.

U.S. Pat. No. 7,006,848 discloses a spring biased clamp for attaching two concave members around an existing pole. The clamp is used for mounting a band of stiff material that extends outside the mouth of the goal to provide a guide for proper positioning of the goaltender.

U.S. Pat. No. 7,134,976 discloses a training device with adjustable target devices which are capable of being rotated relative to a strut mounted to the posts or cross bar of a goal. The strut may be mounted to the uprights or crossbar by straps, clamps, brackets, pins, screws, nails, etc.

BRIEF SUMMARY OF THE INVENTION

With parenthetical reference to the corresponding parts, portions or surfaces of the disclosed embodiment, merely for the purposes of illustration and not by way of limitation, the present invention provides an adjustable target system (32) for use on a goal (20) having a first post (23), a second post (26), and a crossbar (29).

The adjustable target system (32) comprises a frame (35).

A bracket (44) is configured and arranged for adjustably attaching the frame (35) to one of the first post (23), second post (26), and crossbar (29). The bracket (44) is configured and arranged for removably attaching to one of the first post (23), second post (26) and crossbar (29) without the use of tools.

A target (65) is supported by the frame (35).

In another aspect of the invention, the frame (35) comprises a vertical member (38).

In another aspect of the invention, the frame (35) comprises a horizontal member (41).

In yet another aspect, the frame (35) comprises a horizontal member (38) and a vertical member (41).

The system comprises the bracket (44) having female and male opposed members (71, 92). The female opposed member (71) has a first arcuate portion (74) configured and arranged to extend around one of the first post (23), second post (26), and crossbar (29). The female opposed member (71) has a second arcuate portion (77) configured and arranged to extend around the frame (35). The male opposed member (92) has a first arcuate portion (95) configured and arranged to extend around one of the first post (23), second post (26), and crossbar (29). The male opposed member (92) has a second arcuate portion (98) configured and arranged to extend around the frame (35).

The system further comprises the male bracket member (92) having a section (101) extending from the first arcuate portion (95) and a protrusion (104) extending from the section (101).

In another aspect, the female bracket member (71) has a section (80) extending from the first arcuate portion (74). The section (80) has an opening (83) defined therein. The opening (83) is configured and arranged to receive the protrusion (104) when the female and male bracket members (71, 92) are attached around one of the first post (23), second post (26), and cross bar (29).

In yet another aspect of the invention, the protrusion (104) may be L-shaped.

The system further comprises an adjustable target system (32) for use on a goal (20) having a first post (23), a second post (26), and a crossbar (29). The adjustable target system (32) comprises a frame (35).

A bracket (44) is configured and arranged for adjustably attaching the frame (35) to one of the first post (23), second post (26), and crossbar (29). The bracket (44) is configured and arranged for removably attaching to one of the first post (23), second post (26) and crossbar (29) without the use of tools. The bracket (44) comprises female and male opposed members (71, 92). The female opposed member (71) has a first arcuate portion (74) configured and arranged to extend around one of the first post (23), second post (26), and crossbar (29). The female opposed member (71) has a second arcuate portion (77) configured and arranged to extend around the frame (35). The male opposed member (92) has a first arcuate portion (95) configured and arranged to extend around one of the first post (23), second post (26), and crossbar (29). The male opposed member (92) has a second arcuate portion (98) configured and arranged to extend around the frame (35). The male bracket member (92) has a section (101) extending from the first arcuate portion (95) and an protrusion (104) extending from the section (101). The female bracket member (71) has a section (80) extending from the second arcuate portion (74). The section (80) has an opening (83) defined therein. The opening (83) is configured and arranged to receive the protrusion (104) when the male and female bracket portions (92, 71) are attached around one of the first post (23), second post (26), and crossbar (29).

DESCRIPTION OF THE PREFERRED EMBODIMENTS

Figure 1:
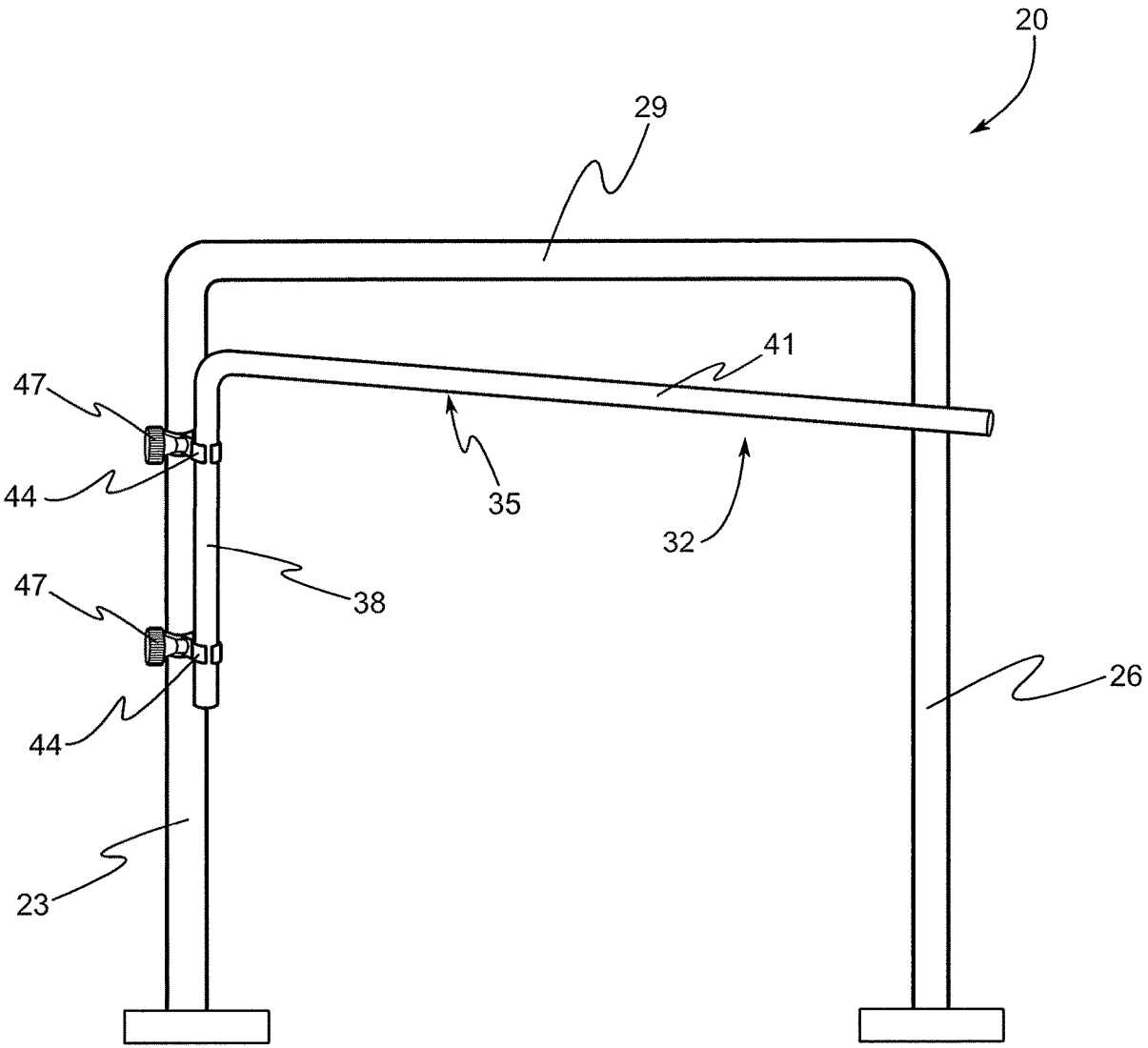
FIG. 1 is a front perspective view of one embodiment of the adjustable target system of the present invention.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, debris, etc.) together with the specification, and are to be considered a portion of the entire written description of this invention. As used in the following description, the terms "horizontal", "vertical", "left", "right", "up" and "down", as well as adjectival and adverbial derivatives thereof, (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or of rotation, as appropriate.

Figure 2:
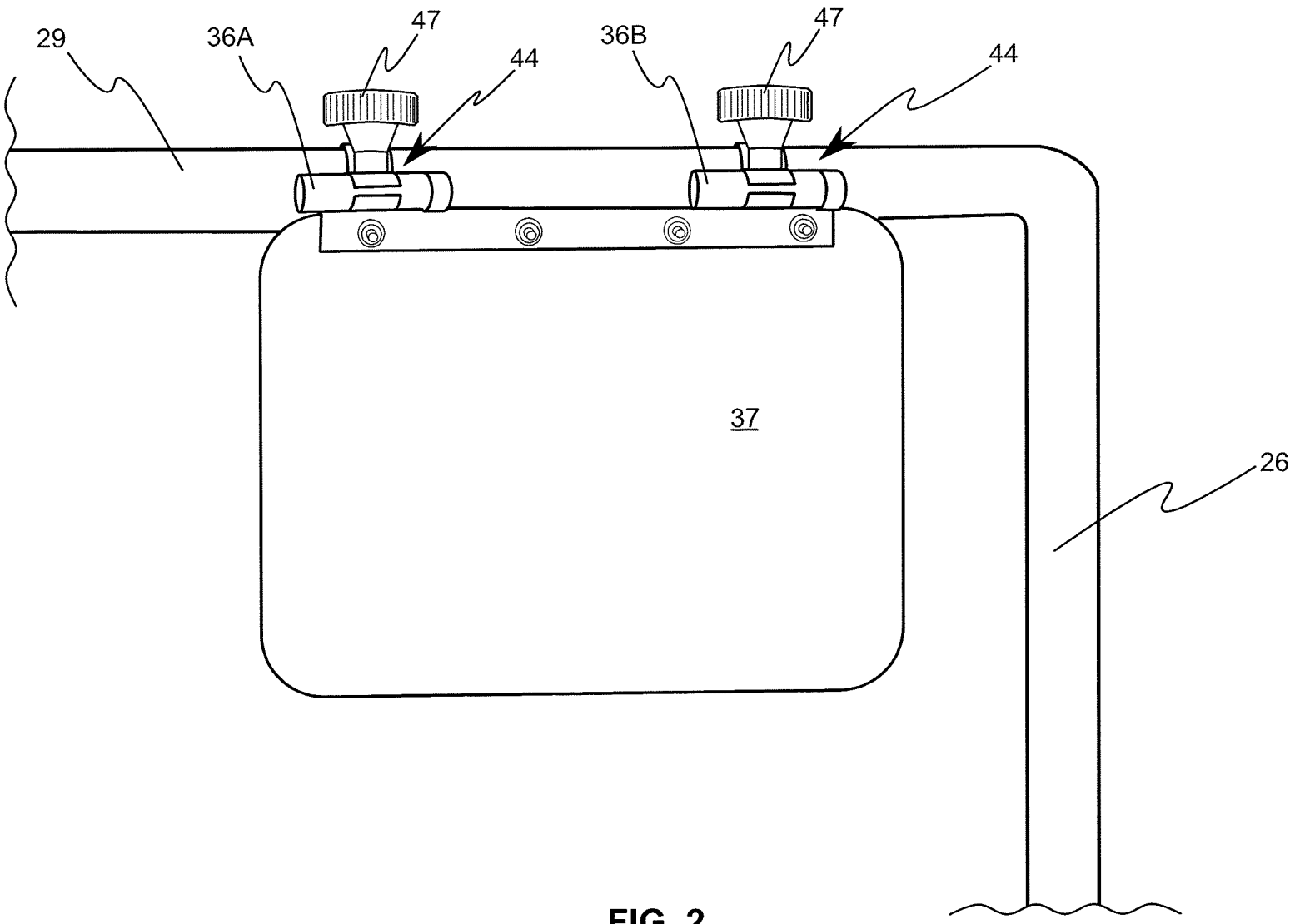
FIG. 2 is a partial front perspective view of another embodiment of the adjustable target system of the present invention.
Figure 3:
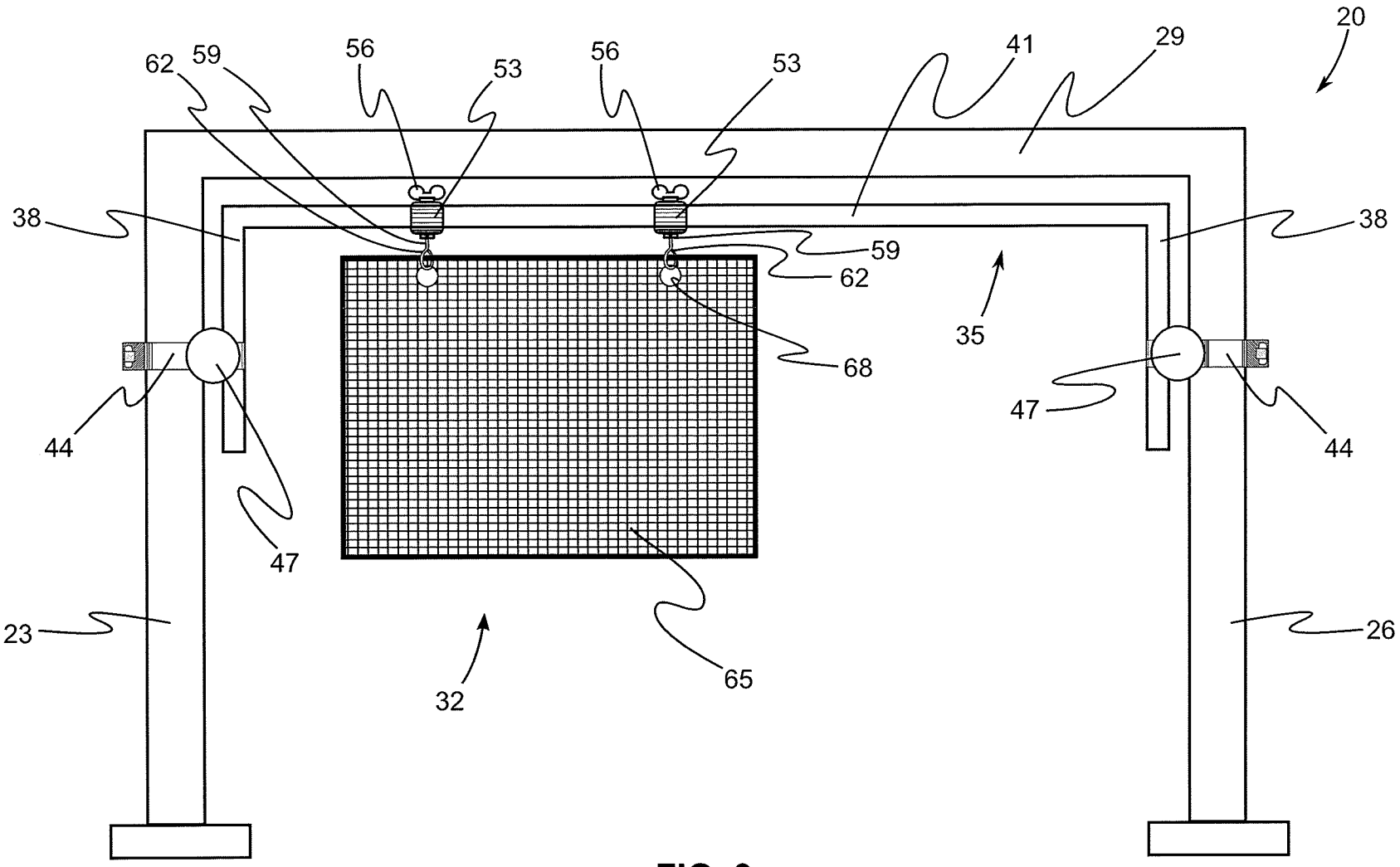
FIG. 3 is a front elevational view of another embodiment of the adjustable target system of the present invention mounted on a goal.

Referring now to the drawings, and more particularly to FIGS. 1-3 thereof, an embodiment of the invention is shown in connection with a goal 20 having a first post 23, a second post 26, and a crossbar 29. These three elements form the mouth of the goal 20 which is typically positioned at the goal line of a field or playing surface. When the ball or puck passes over the goal line between the posts 23, 26 and underneath the cross bar 29 during play, a goal is scored. In order to train athletes to shoot at specific targets inside the goal 20, an adjustable target system 32 may be mounted on the goal 20.

The adjustable target system 32 includes a frame 35 that may be constructed of a material such as a metal or the like and may comprise hollow tubing to reduce its weight. The frame 35 may comprise one or more vertical members 38 and one or more horizontal members 41. The frame 35 may also include diagonal members or members oriented at varying angles relative to the posts 23, 26, and crossbar 29. The frame 35 may be constructed with a smaller diameter than the posts 23, 26 or the crossbar 29. The frame 35 may have a unitary construction or may be constructed in sections capable of being attached to one another during assembly of the system 32.

As will be described in greater detail herein, one or more brackets 44 may be attached around the first post 23, the second post 26 or the crossbar 29 at one end and attached around the frame 35 at the opposite end. A manually operated knob 47 may be provided for removably attaching the bracket 44 to the post 23, 26 or crossbar 29, without the use of tools. When the knob 47 is turned to tighten against a screw 50 (FIG. 12), the bracket 44 is clamped into a first position. Loosening the bracket 44 by turning the knob 47 in the opposite direction releases the bracket 44 from the post 23, 26 or crossbar 29 and the frame 35. Once the bracket 44 is released it can be moved to a different position.

In FIG. 1, the frame 35 is shown without a target attached. As described herein, the target may be a cloth or other flexible material with a horizontal sleeve at the top for receiving horizontal member 41. The connection of vertical member 38 to post 23 may provide for angular adjustment of the horizontal member 41 relative to the goal 20. In the configuration shown in FIG. 1, an opening in the top right hand corner of the goal 20 is created for shooting at a target in that area.

In FIG. 2, a pair of frame elements 36A and 36B may be attached to the top of a solid blocker 37. The frame elements 36A and 36B may be configured and arranged to be received by arcuate portions of cooperating bracket members forming bracket 44 as described below.

Figure 4:
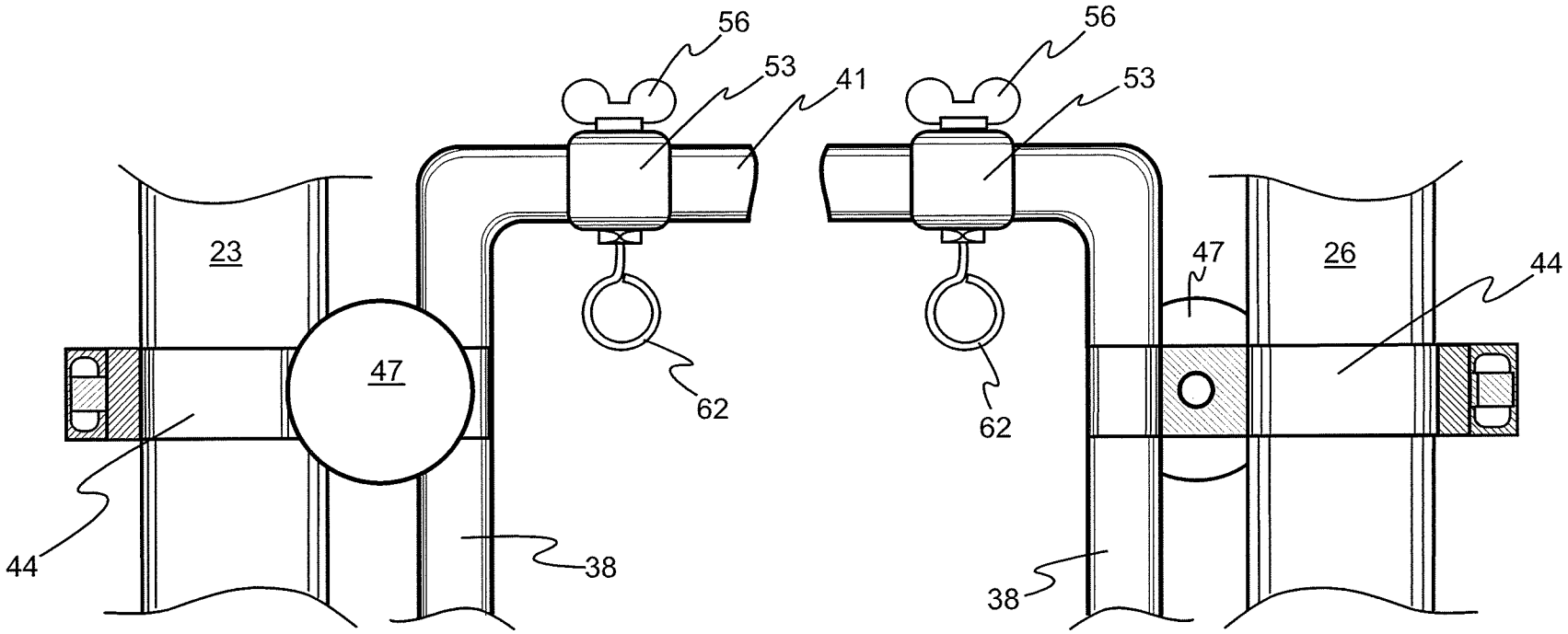
FIG. 4 is an enlarged front elevational view of a portion of the adjustable target system.

Turning to FIGS. 3-4, one or more collars 53 may be configured and arranged to slide over the frame 35. A wing screw 56 may be used to releasably fix the position of the collar 53 relative to the frame 35, without the use of tools. Other fasteners may also be suitable for removably attaching the collar 53 to the frame 35 as will be evident to persons of ordinary skill in the art based on this disclosure. A screw 59 having a hook 62 may extend from the collar 53 on the side opposite from the wing screw 56.

A target 65 may comprise a net having eyelets 68 that may be supported from the frame 35 by the hooks 62. Other targets may also be provided of rigid or flexible materials. A flexible material having a horizontal sleeve across the top may be provided for mounting on horizontal member 41 (FIG. 1). Also, blocker 37 may be formed from a solid, rigid material.

Figure 6:
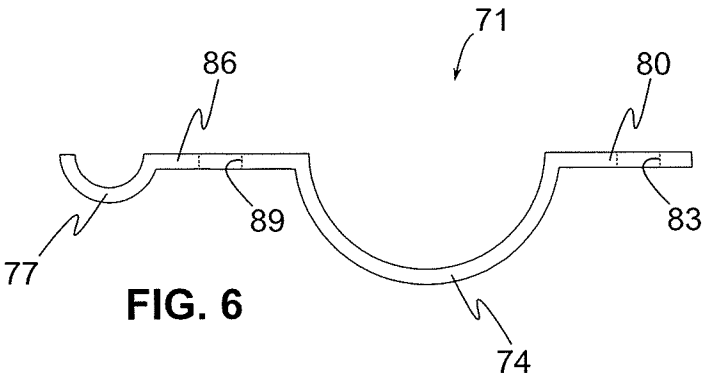
FIG. 6 is a side view of the female portion of the bracket.
Figure 7:
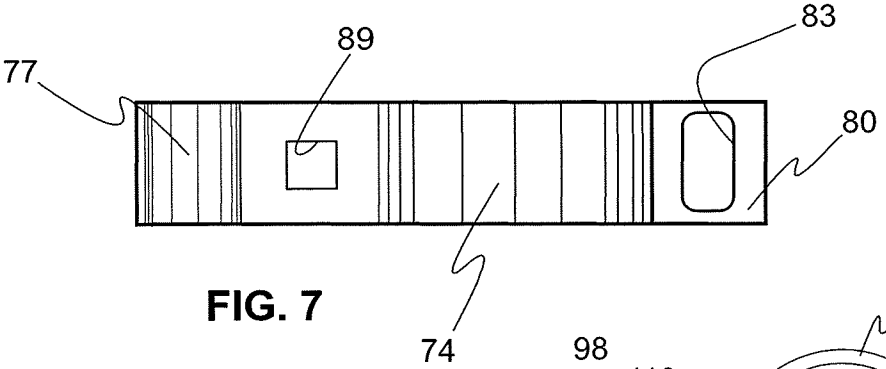
FIG. 7 is a top plan view of the female portion of the bracket.

Turning to FIGS. 6-7, a female bracket member 71 has a first arcuate portion 74 sized to receive one of the posts 23, 26 or crossbar 29 and has a second arcuate portion 77 sized to receive the frame 35. A first portion 80 extends from the first arcuate portion 74 and has an opening 83 defined therein. A second portion 86 extends between the first arcuate portion 74 and the second arcuate portion 77. The second portion 86 has an opening 89 defined therein. The female bracket member 71 may be constructed of a durable material such as a metal.

Figure 8:
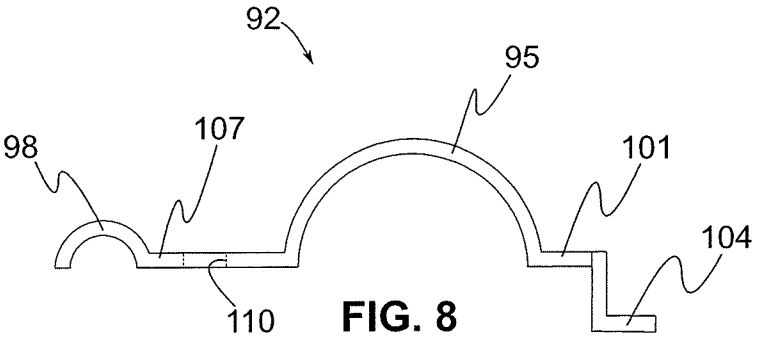
FIG. 8 is a side view of the male portion of the bracket.
Figure 9:
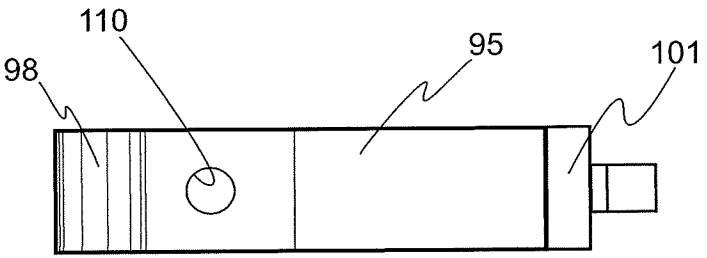
FIG. 9 is a top plan view of the male portion of the bracket.

Turning to FIGS. 8-9, a male bracket member 92 has a first arcuate portion 95 sized to receive one of the posts 23, 26 or crossbar 29 and has a second arcuate portion 98 sized to receive the frame 35. A first portion 101 extends from the first arcuate portion 95 where it connects with a protrusion 104 that may be L-shaped. The protrusion 104 may have rounded corners. The protrusion 104 is configured and arranged such that when the female and male bracket members 71, 92 are interlocked (FIGS. 5 and 10) the protrusion 104 extends through the opening 83 such that, when the female and male members 71, 92 are facing each other, a portion of the protrusion 104 is disposed on the side of the female bracket member 71 opposite from the male bracket member 92. With the protrusion 104 disposed on the side of the female bracket member 71 opposite from the male bracket member 92, the two ends of the female and male bracket members 71, 92 are held in position adjacent to each other while the bracket 44 is being installed.

A portion 107 on the male bracket member 92 extends between the first and second arcuate portions 95 and 98. The portion 107 has an opening 110 defined therein. The male bracket member 92 may be constructed from a durable material such as a metal or the like.

Figure 5:
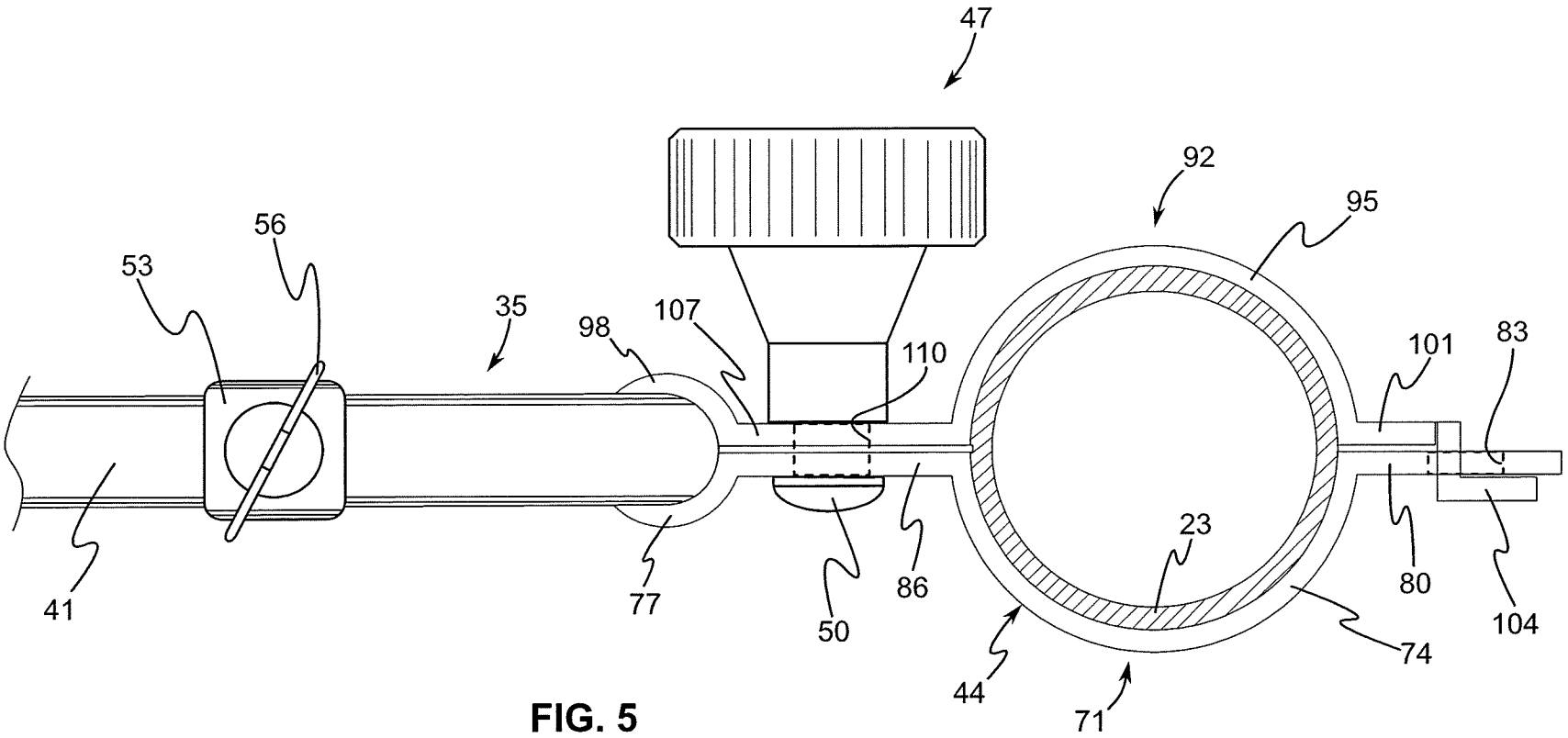
FIG. 5 is top plan view of a portion of the adjustable target system with a portion of the goal cut away.
Figure 10:
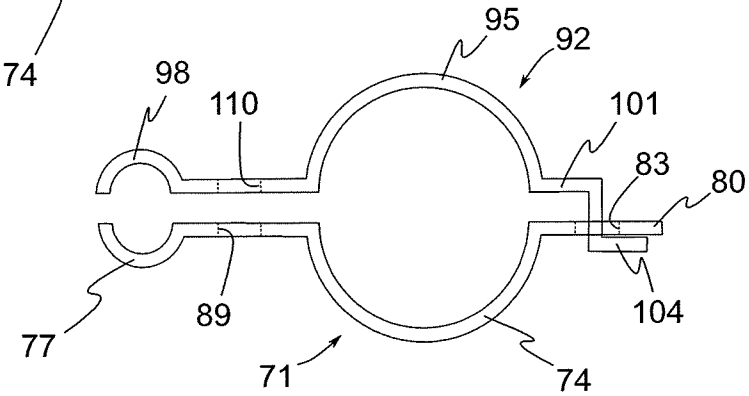
FIG. 10 is a side view of the male and female bracket portions disposed in interlocking arrangement.

As best shown in FIGS. 5 and 10, the female bracket member 71 and the male bracket member 92 are shown in the interlocking position where protrusion 104 of the male bracket member 92 is inserted through the opening 83 in the female bracket member 71. The opening 83 may provide a locating hole for ease of installation. The cooperating protrusion 104 and opening 83 make it easier to connect the female and male bracket members 71, 92 around one of the first post 23, second post 26 and crossbar 29 without the use of tools. The end portions of the female and male bracket members 71, 92 can be interlocked by inserting the protrusion 104 through the opening 83. This interlocking engagement holds the female and male bracket members 71, 92 together at one end while the other ends are being connected by means of engagement of the knob 47 and screw 50 through the aligned openings 89, 110 in the bracket members 71 and 92. In operation, the female and male bracket members 71, 92 are placed around one of the first post 23, second post 26 and crossbar 29 with the protrusion 104 of the male bracket 92 inserted through the opening 83 in the female bracket 71 in interlocking fashion to hold the two ends together. While the bracket members 71 and 92 are being positioned, the frame 35 is inserted between the second arcuate sections 77 and 98, and the knob 47 is turned onto the screw 50 to tighten the female and male bracket members 71, 92 against each other. The knob 47 may be tightened sufficiently to completely prevent movement of the frame 35 or may be loose enough so that the frame 35 can be rotated by pushing it from a first position to a second position at different angles relative to the post 23, 26 that the frame 35 is mounted on (as best shown in FIG. 1). Openings 89 and 110 in the respective bracket members 71 and 92 are disposed in alignment such that the screw 50 (FIG. 5) can be inserted through the openings 89, 110. The knob 47 has a threaded opening 119 (FIG. 11) for receiving the screw 50. Tightening of the knob 47 onto the screw 50 brings the female and male bracket members 71, 92 together which tightens them around the posts 23, 26, or crossbar 29 and the frame 35.

Figure 11:
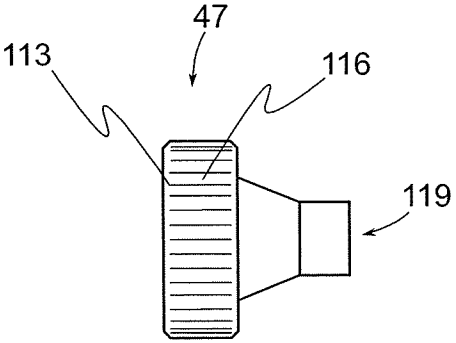
FIG. 11 is a side elevational view of the knob of the present invention.
Figure 12:
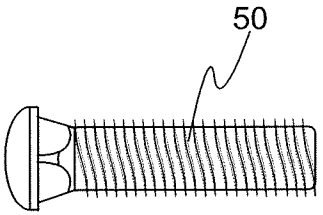
FIG. 12 is a side elevational view of the fastener that engages with the knob shown in FIG. 11.

FIG. 11 shows a detailed side view of the knob 47. The knob 47 has a handle 113 with a set of ridges 116 disposed thereon for ease of gripping by the user. The knob 47 provides for installation of the bracket 44 without the use of tools. The knob 47 has a threaded opening 119 that receives the screw 50 (FIGS. 5 and 12).

Figure 13:
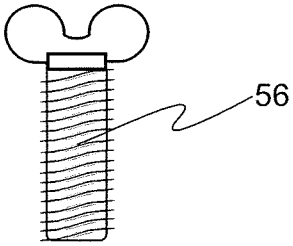
FIG. 13 is a side elevational view of a fastener for use with a collar of the present invention.

FIG. 13 is a detailed view of the wing screw 56 which provides for adjustment of the collar 53 along the frame 35 without the use of tools.

Figure 14:
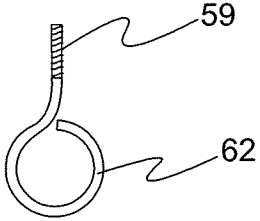
FIG. 14 is a side elevational view of a screw with a hook for use with the collar of the present invention.

FIG. 14 is a detailed view of the screw 59 and hook 62 that may be used to support the target 65 from the frame 35.

Figure 15:
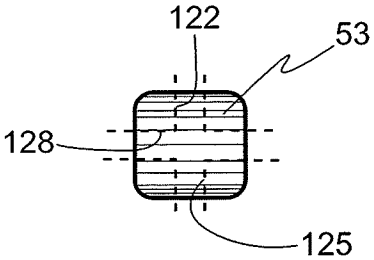
FIG. 15 is a side elevational view of the collar of the present invention.
Figure 16:
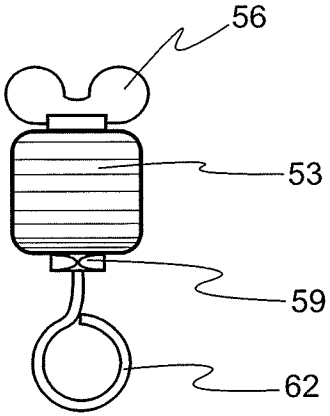
FIG. 16 is a side elevational view of the collar of the present invention with a wing screw and hook screw mounted thereon.

FIG. 15 is a detailed view of the collar 53 which slides over the frame 35 and has opposed threaded passageways 122 and 125 that receive the wing screw 56 and the screw 59. FIG. 16 shows the wing screw 56 and the screw 59 and hook 65 disposed on the collar 53. The collar 53 also has a longitudinal opening 128 for receiving the frame 35.

Figure 17:
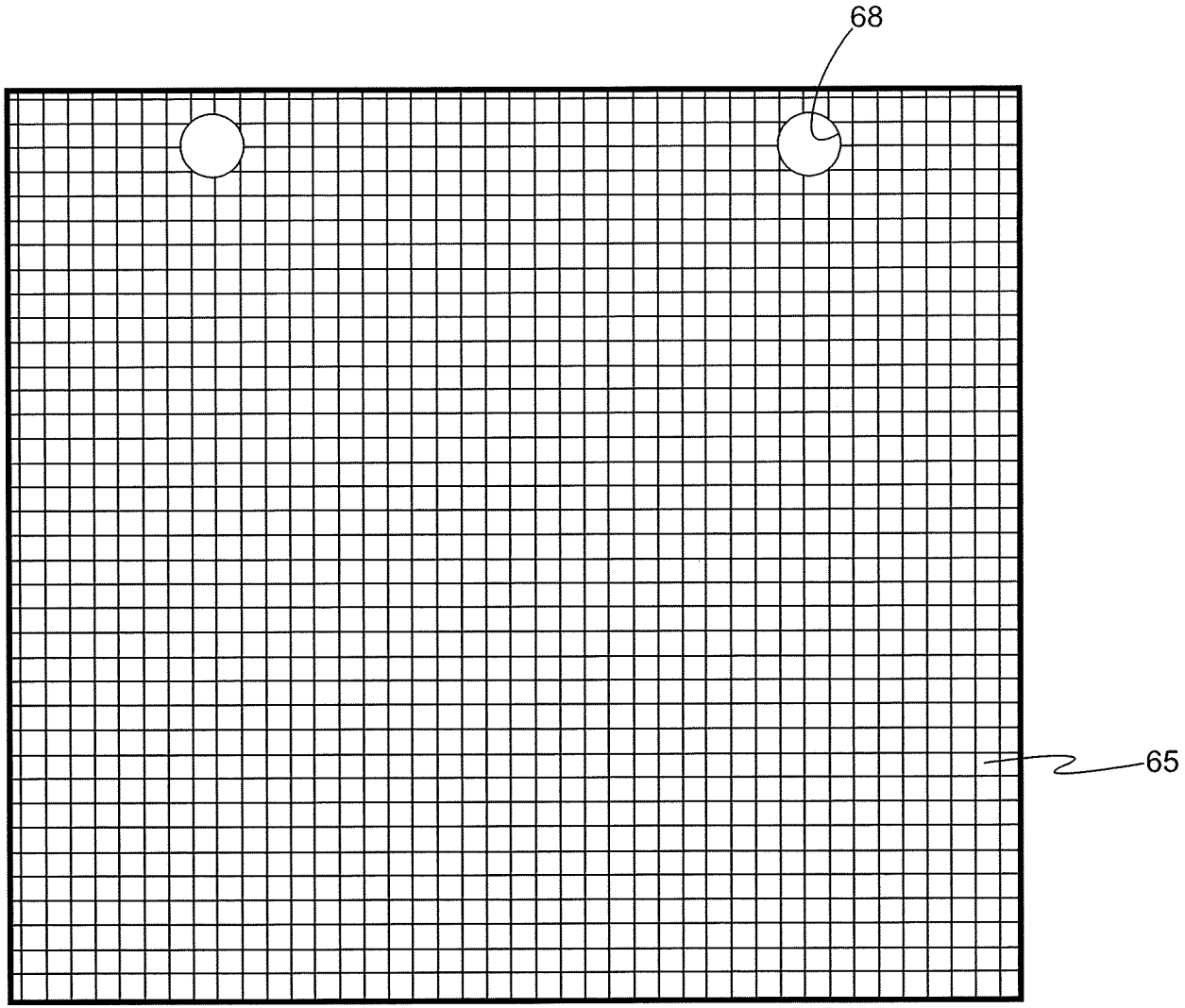
FIG. 17 is a front elevational view of the target of the present invention.

FIG. 17 shows a target 65 in the form of a net having a rectangular shape with a pair of eyelets 68 at the top for mounting the net on the hooks 62 attached to the collar 53. The net may be constructed in different sizes and shapes and of any material. The material shown is a mesh type material with a plurality of vertical and horizontal members forming a grid of openings. Other materials such as solid or colored materials may also be used for the target.

The present invention contemplates that many changes and modifications may be made. Therefore, while the presently-preferred form of the adjustable target system has been shown and described, and several modifications and alternatives discussed, persons skilled in this art will readily appreciate that various additional changes and modifications may be made without departing from the spirit of the invention, as defined and differentiated by the following claims.

The invention claimed is:

1. An adjustable target system for use on a goal having a first post, a second post, and a cross bar, the adjustable target system, comprising:

a frame;

a bracket configured and arranged for adjustably attaching the frame to one of the first post, second post, and crossbar, the bracket configured and arranged for removably attaching to one of the first post, second post and crossbar without the use of tools, wherein the bracket comprises female and male opposed members, the female opposed member having a first female arcuate portion configured and arranged to extend around one of the first post, second post, and crossbar, the male opposed member having a first male arcuate portion configured and arranged to extend around one of the first post, second post, and crossbar, the female opposed member having a second female arcuate portion configured and arranged to extend around the frame, the second female arcuate portion having a free end, the male opposed member having a second male arcuate portion configured and arranged to extend around the frame, the second male arcuate portion having a free end;

wherein the male opposed member has a protrusion extending outward from the first male arcuate portion, wherein the female opposed member has a section extending outward from the first female arcuate portion, the section having an opening defined therein, the opening configured and arranged to receive the protrusion on the male opposed member when the female and male opposed members are attached around one of the first post, second post, and cross bar;

wherein aligned openings on the female and male opposed members receive a manually operated fastener, the fastener configured and arranged to tighten the female and male opposed members against each other around one of the first post, second post, and crossbar and the frame, the manually operated fastener disposed between the frame and one of the first post, second post and crossbar;

wherein the protrusion on the male opposed member extends through the opening in the female opposed member such that a portion of the male opposed member is disposed substantially parallel to the female opposed member when the female opposed member and male opposed member are joined on a side of one of the first post, second post, and crossbar opposite from the frame;

and, a target supported by the frame.

2. The adjustable target system of claim 1, wherein the frame comprises a vertical member.

3. The adjustable target system of claim 1, wherein the frame comprises a horizontal member.

4. The adjustable target system of claim 1, wherein the frame comprises a horizontal member and a vertical member.

5. The adjustable target system of claim 1, wherein the target is a net.

6. The adjustable target system of claim 1, wherein the manually operated fastener comprises a screw and a knob having an internally threaded opening for receiving the screw.

7. The adjustable target system of claim 1, wherein the aligned openings are disposed between the first and second male arcuate portions.

8. The adjustable target system of claim 1, wherein the protrusion comprises an L-shaped member.

9. An adjustable target system for use on a goal having a first post, a second post, and a cross bar, the adjustable target system, comprising:

a frame;

a bracket configured and arranged for adjustably attaching the frame to one of the first post, second post, and crossbar, the bracket configured and arranged for removably attaching to one of the first post, second post and crossbar without the use of tools, wherein the bracket comprises female and male opposed members, the female opposed member having a first female arcuate portion configured and arranged to extend around one of the first post, second post, and crossbar, the male opposed member having a first male arcuate portion configured and arranged to extend around one of the first post, second post, and crossbar, the female opposed member having a second female arcuate portion configured and arranged to extend around the frame, the second female arcuate portion having a free end, the male opposed member having a second male arcuate portion configured and arranged to extend around the frame, the second male arcuate portion having a free end;

wherein the male opposed member has a protrusion extending outward from the first male arcuate portion, wherein the female opposed member has a section extending outward from the first female arcuate portion, the section having an opening defined therein, the opening configured and arranged to receive the protrusion on the male opposed member when the female and male opposed members are attached around one of the first post, second post, and cross bar;

wherein the protrusion on the male opposed member extends through the opening in the female opposed member such that a portion of the protrusion is disposed on the side of the female opposed member opposite from the male opposed member such that the two ends of the male and female opposed members are held together during installation of the bracket;

wherein aligned openings on the female and male opposed members receive a manually operated fastener, the fastener configured and arranged to tighten the female and male opposed members against each other around one of the first post, second post, and crossbar and the frame, the manually operated fastener disposed between the frame and one of the first post, second post and crossbar;

wherein the protrusion on the male opposed member extends through the opening in the female opposed member such that a portion of the male opposed member is disposed substantially parallel to the female opposed member when the female opposed member and male opposed member are joined on a side of one of the first post, second post, and crossbar opposite from the frame;

and, a target supported by the frame.

10. The adjustable target system of claim 9, wherein the frame comprises a vertical member.

11. The adjustable target system of claim 9, wherein the frame comprises a horizontal member.

12. The adjustable target system of claim 9, wherein the frame comprises a horizontal member and a vertical member.

13. The adjustable target system of claim 9, wherein the target is a net.

14. The adjustable target system of claim 9, wherein the manually operated fastener comprises a screw and a knob having an internally threaded opening for receiving the screw.

15. The adjustable target system of claim 9, wherein the aligned openings are disposed between the first and second male arcuate portions.

16. The adjustable target system of claim 9, wherein the protrusion comprises an L-shaped member.

17. The adjustable target system of claim 9, wherein the frame comprises a pair of frame elements mounted on the target.

18. An adjustable target system, comprising:

a goal having a first post, a second post, and a cross bar defining a goal opening;

a frame configured to be mounted within an interior space of the goal;

a bracket configured and arranged for adjustably attaching the frame to one of the first post, second post, and crossbar, the bracket configured and arranged for removably attaching to one of the first post, second post and crossbar without the use of tools, wherein the bracket comprises female and male opposed members, the female opposed member having a first female arcuate portion configured and arranged to extend around one of the first post, second post, and crossbar, the male opposed member having a first male arcuate portion configured and arranged to extend around one of the first post, second post, and crossbar, the female opposed member having a second female arcuate portion configured and arranged to extend around the frame, the second female arcuate portion having a free end, the male opposed member having a second male arcuate portion configured and arranged to extend around the frame, the second male arcuate portion having a free end;

wherein the male opposed member has a protrusion extending outward from the first male arcuate portion, wherein the female opposed member has a section extending outward from the first female arcuate portion, the section having an opening defined therein, the opening configured and arranged to receive the protrusion on the male opposed member when the female and male opposed members are attached around one of the first post, second post, and cross bar;

wherein the female and male opposed members have aligned openings for receiving a manually operated fastener, the fastener configured and arranged to tighten the female and male opposed members against each other around one of the first post, second post, and crossbar and the frame, wherein the aligned openings are disposed between the first and second arcuate portions; and, wherein the manually operated fastener is disposed between the frame and one of the first post, second post and crossbar;

wherein the protrusion on the male opposed member extends through the opening in the female opposed member such that a portion of the male opposed member is disposed substantially parallel to the female opposed member when the female opposed member and male opposed member are joined on a side of one of the first post, second post, and crossbar opposite from the frame;

a target supported by the frame; and wherein the frame is disposed at an acute angle relative to the goal opening.

* * * * *